US010569322B2

(12) United States Patent
Li

(10) Patent No.: US 10,569,322 B2
(45) Date of Patent: Feb. 25, 2020

(54) FORGED WHEEL TRIMMING DIE

(71) Applicant: CITIC Dicastal CO., LTD, Qinhuangdao (CN)

(72) Inventor: Rui Li, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 295 days.

(21) Appl. No.: 15/482,943

(22) Filed: Apr. 10, 2017

(65) Prior Publication Data

US 2017/0291210 A1 Oct. 12, 2017

(30) Foreign Application Priority Data

Apr. 8, 2016 (CN) ..... 2016 1 0216596

(51) Int. Cl.

| | |
|---|---|
| ***B21D 28/34*** | (2006.01) |
| ***B21D 24/16*** | (2006.01) |
| ***B21K 1/38*** | (2006.01) |
| ***B21J 5/02*** | (2006.01) |
| ***B21D 28/32*** | (2006.01) |
| ***B21D 53/26*** | (2006.01) |
| ***B21K 7/12*** | (2006.01) |

(52) U.S. Cl.

CPC ..... *B21D 28/34* (2013.01); *B21D 24/16* (2013.01); *B21D 28/32* (2013.01); *B21D 53/26* (2013.01); *B21J 5/027* (2013.01); *B21K 1/38* (2013.01); *B21K 7/12* (2013.01)

(58) Field of Classification Search

CPC ... B21J 5/02; B21J 5/027; B21J 13/02; B21D 53/26; B21D 53/30; B21D 28/34; B21K 1/28; B21K 1/38

USPC ..... 125/13.02

See application file for complete search history.

(56) References Cited

U.S. PATENT DOCUMENTS 2,411,399 A * 11/1946 Walpole ..... B21J 5/027 83/387

2,443,336 A * 6/1948 Waldie ..... B21D 24/16 219/154

FOREIGN PATENT DOCUMENTS

CN 203304422 U * 11/2013 ..... B21D 28/34

OTHER PUBLICATIONS

Bao, CN 203304422 Translation (Year: 2013).*

* cited by examiner

*Primary Examiner* — Adam J Eiseman
*Assistant Examiner* — Bobby Yeonjin Kim
(74) *Attorney, Agent, or Firm* — Maier & Maier, PLLC

(57) ABSTRACT

An improved forged wheel trimming die, including a connecting rod, a lower die base lower plate, a bottom plate, a stripper guide pillar, a knockout rod, an ejector block, a lower die base stiffened plate, a lower die base upper plate, a lower die, a stripper plate, follow-up retainer plates, a shearing blade and a trimming rod. The improved forged wheel trimming die has the advantages that by adding two follow-up retainer plates to the stripper plate of the die, burrs of a forged wheel blank are constrained along the radial direction during the cutting, thereby avoiding breakage due to excessive deformation; in this way, the burrs can be protected from damage and knocked out successfully by the knockout rod after being cut off from the blank.

2 Claims, 1 Drawing Sheet

FORGED WHEEL TRIMMING DIE

TECHNICAL FIELD

The invention relates to the field of automobile parts, in particular to a forged wheel trimming die.

BACKGROUND ART

In practical production, there are irregular occasions where forged burrs break after a trimming procedure finishes trimming, and these are due to various reasons such as forming of a forged wheel, pick-and-place position of a blank, and shutdown of equipment due to accidental equipment failure; if operating staff fail to remove the broken burrs manually in time after finishing other working, in many cases the broken burrs cannot be knocked out and remain on the surface of a trimming lower die and thus are pressed into a subsequent blank, and in this case the blank will directly be scrapped and forging yield decreases. Therefore, there is a pressing need for a device capable of removing forged burrs.

SUMMARY OF THE INVENTION

The objective of the invention is to design an improved forged wheel trimming die to enable a great reduction for forged wheel blank crushed rejects caused by flash breakage or knockout failure.

In one aspect of the invention, the invention provides an improved forged wheel trimming die, consisting of a connecting rod (2), a lower die base lower plate (3), a bottom plate (4), a stripper guide pillar (5), a knockout rod (6), an ejector block (7), a lower die base stiffened plate (8), a lower die base upper plate (9), a lower die (10), a stripper plate (11), a follow-up retainer plate (12), a shearing blade (13) and a trimming rod (14), the lower die base lower plate (3) is fixed on the bottom plate (4) through bolts, the stripper guide pillar (5) and the lower die base stiffened plate (8) are fixed on the lower die base lower plate (3) through bolts, the connecting rod (2) is fixed on the knockout rod (6) through a bolt, the lower die base upper plate (9) is fixed on the lower die base stiffened plate (8) through bolts, the stripper plate (11) is fixed on the connecting rod (2) through bolts, the lower die (10) is mounted on the lower die base upper plate (9) through bolts, the follow-up retainer plate (12) is fixed on the stripper plate (11) by means of welding, the shearing blade (13) is mounted on the upper die through a bolt, and the ejector block (7) is fixed below the knockout rod (6) through a bolt.

In a preferred aspect of the invention, the improved forged wheel trimming die comprises two follow-up retainer plates (12) symmetrically positioned on the two sides of the improved forged wheel trimming die.

In other aspects, the invention also provides the following technical scheme: an improved forged wheel trimming die consists of a connecting rod (2), a lower die base lower plate (3), a bottom plate (4), a stripper guide pillar (5), a knockout rod (6), an ejector block (7), a lower die base stiffened plate (8), a lower die base upper plate (9), a lower die (10), a stripper plate (11), a follow-up retainer plate (12), a shearing blade (13), a trimming rod (14) and the like, characterized in that the lower die base lower plate (3) is fixed on the bottom plate (4) through bolts, the stripper guide pillar (5) and the lower die base stiffened plate (8) are fixed on the lower die base lower plate (3) through bolts, the connecting rod (2) is fixed on the knockout rod (6) through bolts, the lower die base upper plate (9) is fixed on the lower die base stiffened plate (8) through bolts, the stripper plate (11) is fixed on the connecting rod (2) through bolts, the lower die (10) is mounted on the lower die base upper plate (9) through bolts, the follow-up retainer plate (12) is fixed on the stripper plate (11) by means of welding, the shearing blade (13) is mounted on the upper die (not completely depicted in the drawings) through bolts, and the ejector block (7) is fixed below the knockout rod (6) through a bolt.

The improved forged wheel trimming die of the invention has the advantages that by adding two follow-up retainer plates to the stripper plate of the die, burrs of a forged wheel blank are constrained along the radial direction during the cutting, thereby avoiding breakage due to excessive deformation; in this way the burrs can be protected from damage and knocked out successfully by the knockout rod after being cut off from the blank. The blank abandonment can be avoided which is caused by the burrs that cannot be knocked out after breakage and that remain on the die surface and are pressed into a subsequent blank.

BRIEF DESCRIPTION OF THE DRAWINGS

The embodiments of the invention will be described in detail below in conjunction with the accompanying drawings, wherein.

Figure 1:
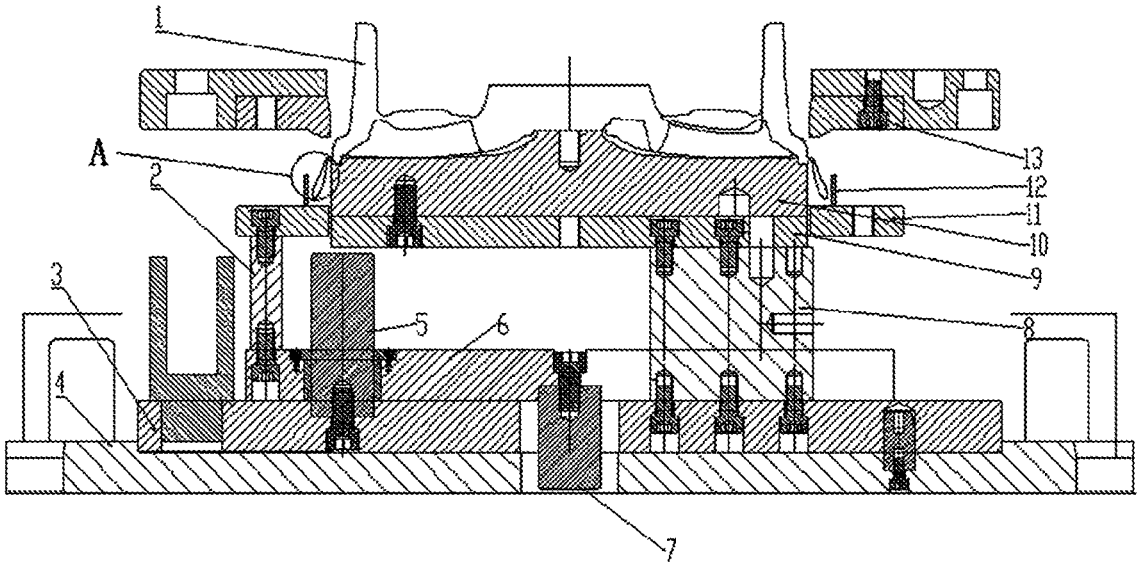
FIG. 1 is a front view of the improved forged wheel trimming die of the invention.
Figure 2:
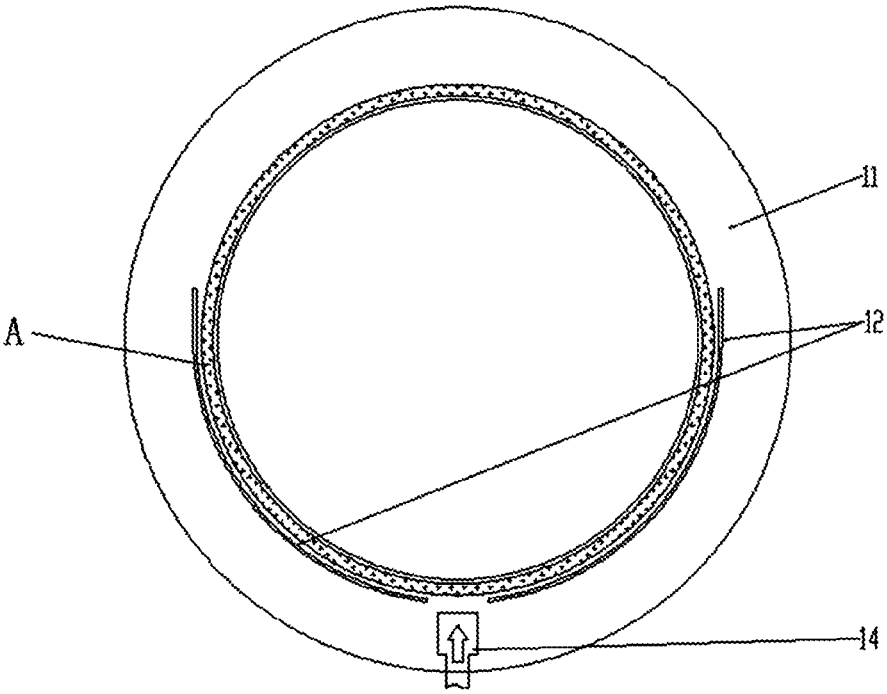
FIG. 2 is a top diagram of the improved forged wheel trimming die of the invention.

In the drawings, 1 depicts blank, 2 connecting rod, 3 lower die base lower plate, 4 bottom plate, 5 stripper guide pillar, 6 knockout rod, 7 ejector block, 8 lower die base stiffened plate, 9 lower die base upper plate, 10 lower die, 11 stripper plate, 12 follow-up retainer plate, 13 shearing blade, and 14 trimming rod.

DETAILED DESCRIPTION OF THE INVENTION

Embodiment 1

The improved forged wheel trimming die of the embodiment consists of a connecting rod (2), a lower die base lower plate (3), a bottom plate (4), a stripper guide pillar (5), a knockout rod (6), an ejector block (7), a lower die base stiffened plate (8), a lower die base upper plate (9), a lower die (10), a stripper plate (11), follow-up retainer plates (12), a shearing blade (13) and a trimming rod (14), the lower die base lower plate (3) is fixed on the bottom plate (4) through bolts, the stripper guide pillar (5) and the lower die base stiffened plate (8) are fixed on the lower die base lower plate (3) through bolts, the connecting rod (2) is fixed on the knockout rod (6) through bolts, the lower die base upper plate (9) is fixed on the lower die base stiffened plate (8) through bolts, the stripper plate (11) is fixed on the connecting rod (2) through bolts, the lower die (10) is mounted on the lower die base upper plate (9) through bolts, the follow-up retainer plates (12) are fixed on the stripper plate (11) by means of welding, the shearing blade (13) is mounted on the upper die through bolts, and the ejector block (7) is fixed below the knockout rod (6) through a bolt. The improved forged wheel trimming die comprises the two follow-up retainer plates (12) symmetrically positioned on the two sides of the improved forged wheel trimming die.

Operating process: the upper die begins operating and moves down with a press slide after a blank (1) is put on the lower die (10). The downward movement stops at a downward movement stopping point, and by this time the shearing blade (13) has already finished the shearing action on burrs of the blank (1). The follow-up retainer plates (12) also finish the radial constraint on the burrs during the shearing so as to effectively lower the breaking probability of the blank. The upper die moves upward to return to its original position with the press slide, the blank (1) is removed by a mechanical arm, then the ejector block (7) drives the connecting rod (2) and the stripper plate (11) to jointly rise under the action of a lower ejector block structure of a press, by this time the burrs are on the stripper plate (11) and will stop until the upper surface of the stripper plate (11) is higher than a highest point of the lower die (10), then the trimming rod (14) is activated to knock out the burrs, the ejector block (7) returns to its original position, and the whole die restores to its initial state and waits for next operation.

The invention claimed is:

1. An improved forged wheel trimming die, comprising: a connecting rod, a lower die base lower plate, a bottom plate, a stripper guide pillar, a knockout rod, an ejector block, a lower die base stiffened plate, a lower die base upper plate, a lower die, a stripper plate, follow-up retainer plates, a shearing blade and a trimming rod, wherein the lower die base lower plate is fixed on the bottom plate by bolted connection, the stripper guide pillar and the lower die base stiffened plate are fixed on the lower die base lower plate by bolted connection, the connecting rod is fixed on the knockout rod by bolted connection, the lower die base upper plate is fixed on the lower die base stiffened plate by bolted connection, the stripper plate is fixed on the connecting rod by bolted connection, the lower die is mounted on the lower die base upper plate by bolted connection, the follow-up retainer plates are fixed on the stripper plate by means of welding, the shearing blade is mounted on an upper die by bolted connection, and the ejector block is fixed below the knockout rod by bolted connection.

2. The improved forged wheel trimming die according to claim 1, wherein the number of the follow-up retainer plates is two, and the two follow-up retainer plates symmetrically positioned on both sides of the improved forged wheel trimming die.

* * * * *